US005186823A

United States Patent [19]

Robinson

[11] Patent Number: 5,186,823

[45] Date of Patent: Feb. 16, 1993

[54] HYDROCYLONE APPARATUS FOR SEPARATING DENSE PARTICLES FROM A FLOWING LIQUID

[75] Inventor: William Robinson, Täby, Sweden

[73] Assignee: A. Ahlstrom Corporation, Noormarkku, Finland

[21] Appl. No.: 678,291

[22] PCT Filed: Jul. 24, 1990

[86] PCT No.: PCT/FI90/00185

§ 371 Date: May 31, 1991

§ 102(e) Date: May 31, 1991

[87] PCT Pub. No.: WO91/01810

PCT Pub. Date: Feb. 21, 1991

[30] Foreign Application Priority Data

Aug. 3, 1989 [SE] Sweden ..... 890266

[51] Int. Cl.[5] ..... B04C 9/00

[52] U.S. Cl. ..... 210/197; 210/195.1; 210/304; 210/512.1; 210/533; 210/540; 209/144; 209/211; 55/459.1; 55/459.4

[58] Field of Search ..... 210/195.1, 197, 304, 210/512.1, 533, 540; 55/459.1–459.5; 209/144, 211

[56] References Cited

U.S. PATENT DOCUMENTS

| | | | |
|---|---|---|---|
| 3,259,246 | 7/1966 | Stavenger | 210/195 |
| 3,489,286 | 1/1970 | Estabrook | 209/211 |
| 3,529,724 | 9/1970 | Maciula et al. | 210/197 |
| 4,267,048 | 5/1981 | Ohishi | 209/211 |
| 4,334,986 | 6/1982 | Frykhult | 210/304 |

FOREIGN PATENT DOCUMENTS

WO9009242 8/1990 PCT Int'l Appl. .

OTHER PUBLICATIONS

Derwent Abstract No. 85-182311/30, S.U. 1060232A.

*Primary Examiner*—Robert A. Dawson
*Assistant Examiner*—David Reifsnyder
*Attorney, Agent, or Firm*—Cohen, Pontani, Lieberman, Pavane

[57] ABSTRACT

A hydrocyclone apparatus is described for removing coarse particles, such as sand, metal chips, etc., from a fiber suspension liquid, whereby the apparatus separates coarser particles from the so called reject obtained from the cleaning process. The apparatus thus enables the reutilization of the reject, thus salvaging the remaining fiber material. The apparatus comprises a hydrocyclone installed in a cylinder, into which the reject flows out, with the entrained heavier and coarser particles, which settle out and are gathered at the bottom of the cylinder for discharge. The liquid rising in the cylinder flows through an overflow outlet to a separate side cylinder, which is open to the atmosphere, in which chamber further settling takes place. An inwardly extending pipe is arranged to extend in the reject nozzle of the cyclone from the upper portion of the auxiliary chamber. The reduced pressure condition therein extends through the inwards extending pipe, protruding into the auxiliary chamber, and liquid is drawn into the cyclone. The apparatus optionally may include several side chambers, which can be combined in series, one after another, for an improved cleaning process.

7 Claims, 3 Drawing Sheets

HYDROCYLONE APPARATUS FOR SEPARATING DENSE PARTICLES FROM A FLOWING LIQUID

BACKGROUND OF THE INVENTION

The present invention relates to a means for cleaning liquid suspensions, especially fiber suspensions used in paper manufacturing. Apparatuses of the type according to the present invention are generally constructed and used as a part of hydrocyclones, which due to their generally simple construction and lack of movable parts have proved to be especially suitable for this kind of cleaning.

Cleaning of fiber suspensions by means of hydrocyclones, on a so called centrifugal principle is in many cases a complicated process, since the majority of the particles being separated have a density (specific weight) very close to each other. On one hand, there are the "useful" particles, such as cellulose fibers, and on the other hand there are various fouling particles, plastic particles and other impurities. Both groups have densities so close to each other that the separation thereof in one stage becomes difficult. Therefore, cyclones are mounted in a combined system (for example, using so called cascade coupling), wherein fiber suspensions are recirculated through the cyclones and thus subject to multi-stage cleaning.

A hydrocyclone operates, as known, by receiving the liquid to be cleaned, the so called feed, and by rapidly rotating it so that the lighter particles accumulate at the center, whereas the heavier particles approach the periphery, due to the centrifugal forces acting on the particles of differing density. The circulating liquid is distributed and discharged from the cyclone such that the major portion escapes through a central discharge opening at the near end of the cyclone with respect to the feed, forming a so called accept, whereas the portion with the separated particles circulating in the periphery is transported towards the bottom of the cyclone to be discharged as a so called reject. As described above, separation can seldom be carried out completely in a single stage or cyclone passage, since the reject still includes separable useful particles which should not be wasted and thus the cleaning continues from apparatus to apparatus in the described manner.

Cyclone type cleaning methods are concerned with the separation of particles, the density of which are close to each other as discussed above. In mixed cascade connected systems, the coarser and heavier particles that occur in the feed must also be discharged, for example sand, metal particles and other heavier impurities. These are together termed the coarse particles. The probability that these will cause problems may be quickly eliminated by slinging them towards the periphery of the cyclone in order to be discharged with the reject. These heavy particles are entrained in the subsequent cleaning stages and are concentrated continuously, remaining in the final reject, which includes all matter that is separated from the completely treated fiber suspension.

This final reject is not immediately discharged because it still includes useful particles, such as coarser fibers and fiber bundles, so called shives, which would be worth recovering. However, prior to recovery, the amounts of coarse particles that occur in the final reject, i.e. sand, metal particles and other coarser scrap must first be discharged, because they have a harmful influence on the means which will treat the reject material, for example on pumps, but above all, on grinding means and refiners. It is also important that the coarse separation is carried out without a large pressure loss. In other words, it should not cost much to remove the coarse particles in order to collect said rest of the usable fibrous material.

There is as such, of course, no problem in separating coarse particles from a liquid or fiber suspension in a cyclone; as already mentioned, the heavier particles are rapidly slung out towards the cyclone wall to glide downwards there along and to be discharged with the reject. It is undesirable to lose some of the liquid with the reject, but rather the discharge is only to get rid of the coarse particles, while the rest of the liquid continues its flow through the system. Known apparatuses use devices often called as "sand traps", see, for example, U.S. Pat. Nos. 3,259,246 or 3,529,724. The reject with the coarse particles is therefore allowed to flow out to a closed chamber, where the particles accumulate while the suspension liquid is delivered in one way or another back into the cyclone through the central part of the reject outlet. A low pressure condition prevails there, drawing the suspension into the cyclone again, from where it flows up along the center of the cyclone and is discharged either through the accept outlet or the reject outlet.

These known apparatuses have in principle two disadvantages. First, when installed in a piping system with flowing liquid so as to form, for example, "sand traps" they produce considerable pressure loss. Second, their separation efficiency is insufficient. Particles which are definitely "coarse", i.e., having a high density, but on the other hand are so small that they possibly pass through, will remain in the accept. This concerns especially particles which are very hard, for example, sand or quartz particles, which can cause difficulties in further processing.

SUMMARY OF THE INVENTION

It is an object of this invention to produce an apparatus, heretofore called a coarse separator, to separate effectively and at low cost these coarse particles from the reject.

The range of use of the coarse separator in accordance with the present invention is not restricted to the environment described above, but rather it can be installed anywhere where a suspension of light particles, both cellulose fibers and other light particles, are to be efficiently removed from sand and other coarser and heavier particles without encountering significant losses of pressure in the cleaning system.

BRIEF DESCRIPTION OF THE DRAWINGS

The preferred embodiments are shown by way of example in the accompanying drawings in which.

DETAILED DESCRIPTION OF THE PREFERRED EMBODIMENTS

Figure 1:
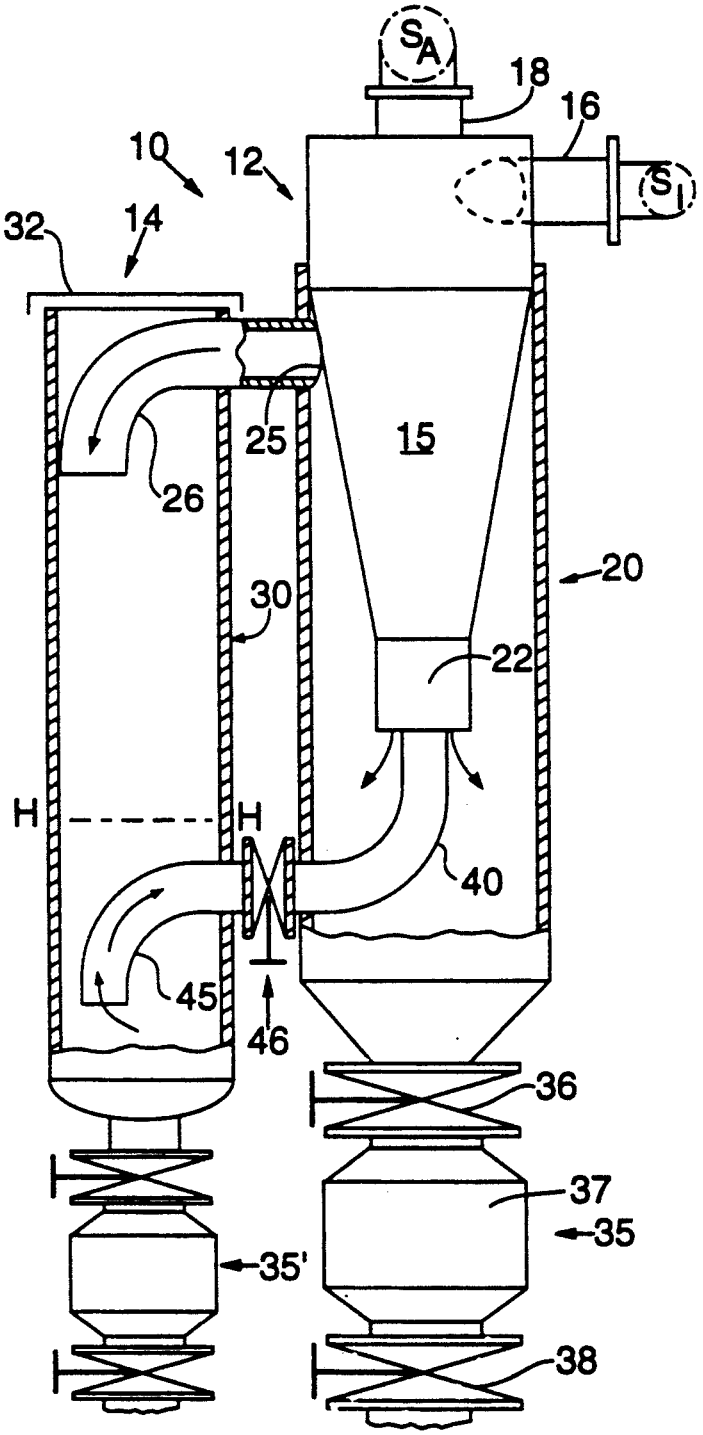
FIG. 1 illustrates a partially sectional total view of the coarse separator from one side.

FIG. 1 illustrates a coarse separator 10 in accordance with the invention, in an embodiment for treating reject, in order to separate coars and abrasive particles, such as sand, metal chips, etc. The coarse separator 10 comprises two main parts, namely a combined cyclone and settling portion 12 and a separate secondary settling chamber or auxiliary chamber 14.

The combined cyclone and settling portion 12 comprises a hydrocyclone 15 of a known type, coaxially installed in a cylinder 20, the main cylinder, in which it extends from the top downwards, as shown in FIG. 1. The cyclone 15 has a feed inlet 16 and an accept outlet 18 and normally flows downwards, into its so called underflow, a cylindrical reject nozzle 22, through which the reject is discharged into the surrounding cylindrical chamber. The lower part of the cylinder 20 is connected to a discharge apparatus 35 of a sluice type, which is described below. The cylinder 20 consists of, in its upper part, an overflow opening 25, a so called over flow channel, through which the liquid flows from the cyclone 15 to the cylinder 20 and ascends upwards in the overflow opening to the auxillary chamber 14, as described in more detail below.

It should be noted that the coarse separator in accordance with the invention forms an open system; in other words atmospheric pressure has free access, in particular to the secondary or auxiliary chamber 14, which contains a auxiliary cylinder 30 pointing openly upwards and being covered by a lid 32. The feed is pumped in at a rather low pressure, 2 to 3 bar, decreasing practically speaking to zero in the accept outlet 18.

The auxiliary chamber 14 comprises an auxillary cylinder 30, the lower part of which is connected in the same way as that of the main cylinder 20 to a discharge apparatus 35', whereas the upper part, as mentioned above, is open to the atmosphere and covered by the lid 32. A pipebend 26 runs from the overflow opening 25 of the main cylinder 20 into the auxiliary chamber 14, which thus receives the liquid flowing out from the cyclone 15 into the main cylinder 20.

Figure 2:
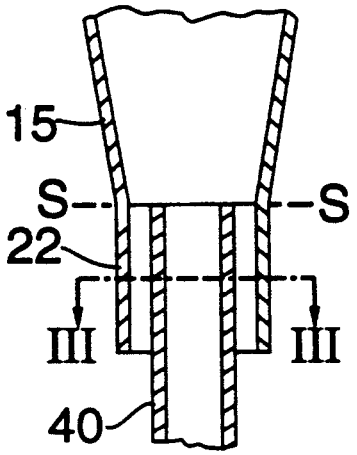
FIG. 2 illustrates a cross sectional detail of the separator on a larger scale.
Figure 3:
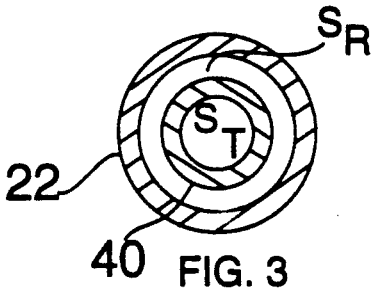
FIG. 3 is a sectional view along line III—III in FIG. 2.

An inwardly extending pipe 40 is mounted to the cylindrical reject nozzle 22 of the cyclone, extending coaxially with the reject opening there through to the level S—S, where the cylindrical reject nozzle 22 is juxtaposed to the conical part of the cyclone 15, as shown in FIG. 2. The inwardly extending pipe 40 then extends out from the cylindrical reject nozzle 22 and bends through the wall of the main cylinder 20 to continue into the auxillary cylinder 30 and where it ends to a downward pipebend 45, as shown in FIG. 1. The inwardly extending pipe 40 as a whole has a trunk-like form. A valve 46 is mounted in the flow path between both cylinders to regulate the flow through the inwardly extending pipe 40.

The coarse separator in accordance with the invention operates in the following manner. The reject coming from a simultaneously operating cyclone cleaning apparatus, and including the coarse material being separated in the apparatus, but also containing a different kind of valuable residual fibers, forms the feed material to the coarse separator 10 in accordance with the invention, and is supplied through the tangentially mounted inlet opening 16 to the coarse separator 10. Usually the liquid is brought into circulation in the cyclone 15 of the separator simultaneously with the downwardly movement towards the bottom outlet, where the rapidly circulating liquid partly turns and rises upwards along the center of the cyclone, partly flows out through the cylindrical reject nozzle 22, between the inner wall thereof and the previously described inwardly extending pipe 40. The outflowing liquid entrains the coarse particles which are almost immediately slung out towards the inner wall of the cyclone 15 so as to follow it downwards. The movement of the outflowing liquid is dampened rapidly in the main cylinder 20 surrounding the cyclone, and the majority of the separated particles fall towards the bottom of the cylinder. As mentioned above the liquid rises in the cylinder so as to flow over the cylinder 20 through the overflow pipe 25 and through the pipebend 26 into the auxillary cylinder 30 of the secondary or auxiliary chamber 14. The purpose of the auxillary cylinder 30 is to thus form a secondary settling chamber complementing the main cylinder 20, in which the liquid transferred through the overflow pipe 25 is allowed to settle under smoother conditions. The coarse particles that have not settled in the main cylinder 20 are now allowed to do so in the auxiliary cylinder 30.

The circulating liquid generates a partial vacuum or reduced pressure zone in the center of the cyclone 15 in a known manner. This reduced pressure zone extends through the inwardly extending pipe to the auxiliary cylinder 30 so that liquid is drawn from it through the trunk-shaped inwardly extending pipe 40 back to the cyclone 15, as indicated with arrows in FIG. 1. The liquid drawn back to the cyclone is drawn upwards in the center of the cyclone, joins with the liquid directly rotating in the bottom outlet and being discharged through the cylindrical reject nozzle 22 and the accept outlet 18, free from coarse particles, but entrained with fine particles which are left in the original reject.

The separated coarse particles are thus gathered to the bottom of the main cylinder 20 and the bottom of the auxiliary cylinder 30. They can then be transferred out in regular intervals by opening, in case of the main cylinder 20, a slide valve 36 so that the coarse material flows down into a gathering chamber 37. When all the coarse material accumulated up to that moment has flowed down, the slide valve 36 is closed, and subsequently a lower slide valve 38 is opened and the gathering chamber 37 is unloaded therethrough. The method is applied to the auxiliary cylinder 30 which is provided with a valve apparatus 35' comprising a similar gathering chamber located between the upper and lower slide valves.

Figure 4:
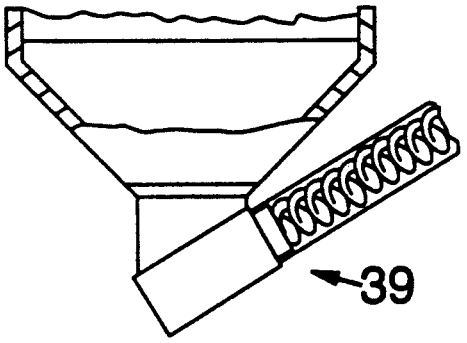
FIG. 4 illustrates an alternative discharge apparatus for the separated material.

It is possible to install a continuously running apparatus in accordance with FIG. 4 instead of the intermittently running discharge apparatus as described above with respect to the valve apparatus 35 and 35'. In that case the valve apparatus 35 or 35' is replaced by an inlet chamber for a screw conveyer 39 which continuously feeds out the separated coarse material which is gathered on the bottom of the cylinder in question.

In a continuous drive, the coarse separator in accordance with the invention is set in the optimal drive conditions by regulating the accept outflow (by adjusting the counter pressure in the accept outlet 18) as well as by regulating the inflow through the inwardly extending pipe 40 by means of the valve 46 mounted therein. The liquid level H—H in the auxiliary cylinder 30 is thereby allowed to settle to an optimal position, which gives a maximal cleaning effect, which can be confirmed by taking a sample of the accept. Practical experiments with the separator in accordance with the present invention have proven that the separation effect was very good, with small sand and bark particles separated which can otherwise be separated only by considerably smaller and more effective hydrocyclones. Additionally saw dust and heavier wood particles are separated and gathered into the settling chambers. A study of the accept from the separator showed that it was practically speaking free of the sand particles and also no saw dust was to be found in it; the accept comprised only water and fine fiber particles.

Certain dimensional conditions for the coarse separator must be fulfilled. As mentioned the conical part of the cyclone 15 concludes with a reject portion comprising a cylindrical reject nozzle 22 with an inwardly extending pipe 40 arranged coaxially therein. It is important that the inner opening of the pipe is at the same level with the S—S level between the conical part of the cyclone and the cylindrical part of the cylindrical reject nozzle 22. The inwardly extending pipe 40 must thus be either extending upwards in the cyclone 15 or downwards in the cylindrical reject nozzle 22, as shown in FIG. 2. The flow surfaces must be such that the area $S_A$ of the accept outlet is greater than the area $S_I$ of the feed inlet, and further that the annular area $S_R$ of the gap between the outside of the inwardly extending pipe 40 and the inside of the cylindrical reject nozzle 22 must be smaller than the inner area $S_T$ of the inwardly extending pipe 40. Finally, the total of both these areas, both the annular gap area $S_R$ and the area $S_T$ of the inwardly extending pipe 40, must be smaller than the area of $S_A$ of the accept outlet. The area conditions can be summarized as follows:

$$S_A > S_I$$

$$S_R < S_T$$

$$S_R + S_T < S_A$$

The coarse separator 10 is, as mentioned, in a condition that it can practically speaking completely separate coarser particles from the flowing liquid, which is for example, a fiber suspension. However, if a hundred per cent separation of these particles, especially those that are very small and hard, such as quartz-type particles, is desired, the cleaner in accordance with the invention can be "refined" and its separation effect further improved. This can take place to an almost unrestricted extent, as can be seen in FIG. 5, which illustrates a coarse separator 50 in accordance with the invention, in which additional, auxiliary chambers or cylinders 60 are interposed between the original auxiliary cylinder 30 and main cylinder 20 with the cyclone 15.

Figure 5:
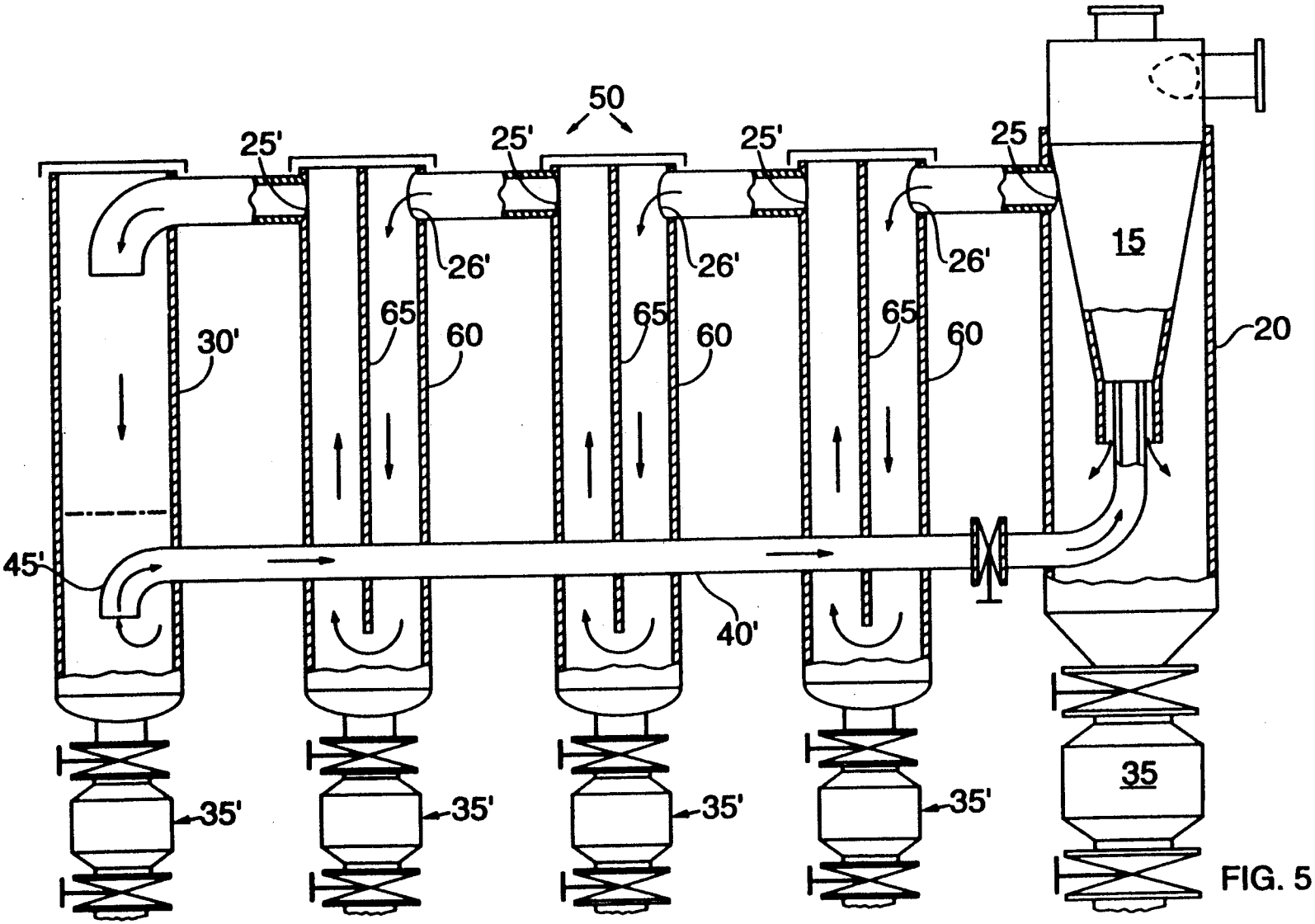
FIG. 5 illustrates a coarse separator in accordance with the invention in which the outer cleaning stage is in the form of additional settling chambers.

FIG. 5 illustrates three such additional auxiliary chambers 60 installed, and every such chamber is provided with a central intermediary plate or wall 65. The overflow from the overflow channel 25 of the main cylinder is supplied to one side of the plate 65 in the first auxiliary chamber 60 and flows downwardly along it. The plate ends at a distance above the bottom of the chamber, and it extends upwards to the level of the open upper end of the chamber. The liquid thus flows downwardly on one side of the plate 65, turns by the bottom of the auxiliary chamber 60, then flows upwardly to an upper overflow channel 25' at the same level as main cylinder's overflow channel 25. A second additional chamber 60 is connected subsequent to the first, relative to the fluid flow, similarly to the first one so that the liquid flows downwardly on one side of the plate and upwardly along the opposite side of the plate so as to continue further to a third additional chamber 60, in which the flow process is repeated. The liquid then continues to a last cylinder 30' which corresponds the original single auxiliary cylinder 30 in accordance with FIG. 1. The inwardly extending pipe 44' from the cyclone 15 extends through—or past—all the extra chambers 60 to the final pipebend 45' in the last cylinder 30' in order to receive and further transfer the liquid to be redrawn into the cyclone 15.

The aggregate in accordance with FIG. 5 operates exactly in the same way as the described separator in accordance with FIG. 1 with the exception that a number of additional settling stages are included in the cleaning process. In each of the extra chambers 60 the liquid has the opportunity under its relatively smooth flow conditions to settle, and the separated sediment is discharged through discharge valves 35', similarly to that described above. The number of the additional settling stages is determined by how long it is desired in the particular case to run the cleaning process, and as described there is the opportunity to clean the liquid/fiber suspension in this way practically speaking one hundred percent.

The described coarse separator is simple in construction, and the lack of constriction in the flow channels decreases the pressure loss to a minimum, and at the same time a high flow through capacity becomes possible. The range of use of a separator in accordance with the invention is not restricted to the above described example of cleaning fiber suspensions, but the separator can be utilized in many cases where heavier particles should be removed from a flowing liquid.

It should be understood that the preferred embodiments and examples described are for illustrative purposes only and are not to be construed as limiting the scope of the present invention which is properly delineated only in the appended claims.

I claim:

1. A hydrocyclone apparatus for separating dense particles from a flowing liquid, comprising:

a main vessel having an upper portion and a lower portion, the lower portion forming a settling chamber, the upper portion of the main vessel having an overflow opening;

a hydrocyclone coaxially mounted within the main vessel, the hydrocyclone having upper and lower ends, the hydrocyclone further comprising inlet means for conducting the liquid into the upper end of the hydrocyclone, and an accept outlet for discharging liquid at the upper end of the hydrocyclone, a cylindrical nozzle portion mounted at the lower end of the hydrocyclone for conducting reject containing the dense particles into the lower portion of the main vessel;

an additional vessel having an upper portion and a lower portion;

a first conduit connected to the overflow opening of the main vessel and extending into the upper portion of the additional vessel; and a second conduit extending from the lower portion of the additional vessel into the cylindrical nozzle portion of the hydrocyclone.

2. The hydrocyclone apparatus according to claim 1, wherein the upper portion of the additional vessel is open to atmosphere.

3. The hydrocyclone apparatus according to claim 1, wherein the hydrocyclone has a conical portion extending upwardly from the cylindrical nozzle portion, and wherein the second conduit extending into the cylindrical nozzle portion has an end at a level where the conical portion and the cylindrical nozzle portion meet.

4. The hydrocyclone apparatus according to claim 1, wherein the accept outlet and the inlet means each have a cross sectional area, wherein the cross sectional area of the accept outlet is greater than the cross sectional area of the inlet means, the second conduit and the cylindrical nozzle portion defining an annular cross sectional area therebetween, the second conduit extending into the cylindrical nozzle portion having an inner cross sectional area, wherein the annular cross sectional area is smaller than the inner cross sectional area of the second conduit.

5. The hydrocyclone apparatus according to claim 4, wherein the annular cross sectional area and the inner cross sectional area together are smaller than the cross sectional area of the accept outlet.

6. The hydrocyclone apparatus according to claim 1, further comprising a valve in the second conduit for regulating flow from the lower portion of the additional vessel to the cylindrical nozzle portion of the hydrocylone.

7. The hydrocyclone apparatus according to claim 1, further comprising at least one intermediate vessel open to atmosphere arranged between the main vessel and the additional vessel, each intermediate vessel having an upper portion and a lower portion and a bottom, and a central intermediary plane extending from the upper portion to a level in the lower portion at a distance from the bottom, each intermediate vessel having an inlet opening and an overflow opening in the upper portion of the intermediate vessel, the inlet opening and the overflow opening being arranged at opposite sides of the intermediary plate, such that the liquid flows from the inlet opening along one side of the plate toward the bottom of the intermediate vessel and then upwardly along an opposite side of the plate toward the overflow opening, wherein the inlet opening of each intermediate vessel is connected to one of the overflow opening of the main vessel and the overflow opening of another intermediate vessel, and wherein the overflow opening of each intermediate vessel is connected to one of the first conduit and the inlet opening of another intermediate vessel.

* * * * *